US006557914B2

(12) United States Patent
Hamilton et al.

(10) Patent No.: US 6,557,914 B2
(45) Date of Patent: May 6, 2003

(54) INTERFERENCE FIT DOORJAMB REINFORCEMENT APPARATUS

(75) Inventors: Scott Kenneth Hamilton, Austin, TX (US); Michelle Scott Hamilton, Austin, TX (US)

(73) Assignees: Scott K. Hamilton, Round Rock, TX (US); Michelle S. Hamilton, Round Rock, TX (US)

( * ) Notice: Subject to any disclaimer, the term of this patent is extended or adjusted under 35 U.S.C. 154(b) by 0 days.

(21) Appl. No.: 09/771,386

(22) Filed: Jan. 26, 2001

(65) Prior Publication Data

US 2001/0054825 A1 Dec. 27, 2001

Related U.S. Application Data

(60) Provisional application No. 60/177,687, filed on Jan. 24, 2000.

(51) Int. Cl.[7] ..... E05B 15/02
(52) U.S. Cl. ..... 292/340; 292/346; 292/1
(58) Field of Search ..... 292/346, 289, 292/288, 1, 340, 341.14

(56) References Cited

U.S. PATENT DOCUMENTS

| | | | | | |
|---|---|---|---|---|---|
| 4,076,294 | A | * | 2/1978 | Holmberg | 292/340 |
| 5,344,198 | A | * | 9/1994 | Elliot | 292/340 |
| 5,456,507 | A | * | 10/1995 | Jones | 292/340 |
| 5,586,796 | A | * | 12/1996 | Fraser | 292/346 |
| 6,082,049 | A | * | 7/2000 | Hudson | 49/460 |

FOREIGN PATENT DOCUMENTS

| | | | | |
|---|---|---|---|---|
| GB | 2224065 | A | * 4/1990 | E05B/17/00 |

* cited by examiner

*Primary Examiner*—J. J. Swann
*Assistant Examiner*—Thomas Ho

(57) ABSTRACT

A doorjamb strengthening device comprising an interior metal plate (1), a primary interior cylindrical reinforcing member (5), an aperture (11), a secondary cylindrical reinforcing member (6), an exterior metal plate (2), a primary exterior cylindrical reinforcing member (9), and a secondary exterior cylindrical connecting member (10). Interior metal plate is fastened to exterior metal plate by means of an interference fit between primary interior cylindrical reinforcing member and primary exterior cylindrical reinforcing member and secondary interior cylindrical connecting member and secondary exterior cylindrical connecting member.

5 Claims, 5 Drawing Sheets

7
2
8
9
10
5
6
22
12
11
3
1
4

INTERFERENCE FIT DOORJAMB REINFORCEMENT APPARATUS

This application claims the benefit of provisional Application No. 60/177,687, filed Jan. 24, 2000.

BACKGROUND

1. Field

This invention relates to doorjamb reinforcing devices. Specifically this invention relates to such devices that reinforce the portion of a doorjamb defined from the interior edge of a deadbolt recess to the interior of a residence.

2. Description of the Background

Forced entry into a residence is a common problem. It is easy for a person with criminal intent to gain access to a residence by forcing an entry door of a residence. Securing an entry door with a deadbolt lock is standard practice. However, a well-placed blow to the region of the door containing the deadbolt lock is all that is required to force the door. The failure of the door to remain locked does not lie with the deadbolt lock but with the area of the doorjamb defined by the edge of the deadbolt recess nearest the interior of the residence to the interior of the residence. This area of the doorjamb is weak, often less than an inch thick, and made of wood incapable of withstanding the force of a blow. The force of a blow drives the deadbolt through the doorjamb causing the doorjamb wood to splinter, thereby allowing a criminal easy access to the residence.

A number of means have been developed to reinforce a doorjamb in the area adjacent the deadbolt lock. Many of these developments are in the form of reinforcing plates designed to be mounted to doorjambs. Typically these devices consist of a flat metal plate that when viewed in cross section have a characteristic U-shape or L-shape. For installation many of these devices call for door molding and or doorjamb facing to be removed. This operation, even when carefully performed, often damages door molding, doorjamb facing, and painted surfaces necessitating costly repairs.

Many of these devices make provisions for the concealment of the invention. This does not provide a visual deterrent against forced entry. A doorway that is readily seen to be reinforced provides a visual deterrent against forced entry. Those with criminal intent prefer an easy target rather than a hard target. If they see that the intended doorway is reinforced they are likely to move on in search of an easier target.

Many of these devices utilize threaded fasteners as a means of attaching the device to or through the doorjamb structural members. Regardless of whether threaded fasteners are perpendicular or parallel with doorjamb and regardless of the depth of the threaded fasteners there is a tendency for the threaded fasteners to splinter through or otherwise damage the doorjamb under the force of a powerful blow. Thus the integrity of the locked door is compromised. Additionally, many of these devices rely on various fastening means that interact solely with doorjamb facing. The doorjamb facing is that portion of the doorjamb that spans and fronts the depth of the doorway. Typically the doorjamb facing is a 4½×1 wood member nailed to underlying doorframe studs. Under the force of a blow the fastening means splinter through the doorjamb facing. Thus the doorjamb facing is an insufficient structural support for such devices.

Furthermore many of these devices have portions that span the surface of the doorjamb facing either completely or partially. Doorjamb faces are not standard. They can be of various widths. Likewise, the stop rails on doorjamb faces can be of various widths, spatial relationships, and thicknesses. These variations in dimensional relationship pose problems in the installation and fit of these devices.

The present invention seeks to eliminate and or avoid the deficiencies stated above. The present invention can be installed without damaging door molding, doorjamb facing, and the accompanying painted surfaces. Additionally the present invention provides a visual deterrent to forced entry. Furthermore the present invention does not utilize threaded fasteners as a means of attachment to or through doorjamb structural members nor does it rely on fastening means that interact solely with the doorjamb facing. In addition the present invention is compatible with doorjamb facing of varying dimensions. Further the present invention seeks to overcome other deficiencies that will become apparent from a consideration of the drawings and ensuing description.

SUMMARY

The present invention is made of metal. The metal of choice is steel but other metals, alloys and composites may be utilized. The present invention may be made using casting and molding processes but any number of manufacturing processes may be utilized. The process of choice is sand casting but any number of casting and molding processes may be utilized in the making and forming of the present invention. The manner of using the present invention is to strengthen the portion of the doorjamb from the interior edge of the deadbolt recess to the interior of the residence. This area of the doorjamb is weak, often less than an inch thick, and made of wood incapable of withstanding the force of a blow. The force of a blow drives the deadbolt through this weak wooden area of the doorjamb causing the doorjamb wood to splinter, thereby allowing a criminal access to the residence.

A doorway is herein defined as a portal in a wall allowing for entrance to the interior of a residence from the exterior of a residence and vice versa. The wall through which the doorway passes has an interior wall surface and an exterior wall surface. The interior wall surface is the surface of the wall fronting the interior of the residence, and is commonly composed of sheetrock panels. The exterior wall surface is the surface of the wall fronting the exterior of the residence and is commonly composed of wood planking or masonry.

The doorway is rectangular in shape and has height, width, and depth. Forming the height of the doorway are two vertical sides. Forming the width of the doorway are two horizontal sides. Forming the depth of the doorway, hereon refereed to as the doorjamb, is that portion of the doorway lying perpendicular too and in between the interior and exterior wall surfaces. Mounted in the doorway is a hinged door. The hinges are mounted on one of the doorways two vertical sides. The side which the hinges are mounted to being refereed to as the hinged side of the doorway while the side that has no hinges mounted there upon being the unhinged side of the doorway.

Fronting the doorjamb is the doorjamb facing which is nailed to the underlying doorframe studs. A feature integral to the doorjamb facing is the stop rail. The stop rail is that portion of the doorjamb that abuts the door when in the closed position.

Framing the doorway on the interior and exterior wall surfaces is door molding. The interior door molding covers up the seam formed by the interior wall surface and the doorjamb facing. Likewise, the exterior door molding covers up the seam formed by the exterior wall surface and the doorjamb facing.

Mounted in the hinged door is a deadbolt lock. When the door is in the closed and locked position the deadbolt protrudes from the lock and enters the deadbolt recess. The deadbolt recess being bored into the doorjamb facing on the unhinged side of the doorway approximately halfway up the length of the doorjamb. The deadbolt recess comprising a top edge, a bottom edge, an exterior edge, and an interior edge. The interior edge being defined as the edge closest the interior of the residence and the exterior edge being defined as the edge closest the exterior of the residence.

The herein described invention allowing that portion of the doorjamb, defined by the interior edge of the deadbolt recess to the interior of the residence, to resist splintering upon the force of a powerful blow. The present invention consists of an interior metal plate composed of an interior-spanning portion shaped to conform to and overlap width of interior door molding and an interior flange portion overlapping interior wall surface. Thus the interior spanning portion and the interior flange portion together form the interior metal plate. The interior metal plate is simply retrofitted on top of the interior door molding and the interior wall surface. Working in conjunction with primary interior cylindrical reinforcing member, interior metal plate serves to brace the portion of the doorjamb from the interior edge of deadbolt recess to the interior of a residence. Additionally the interior metal plate provides rigid structural support for primary interior cylindrical reinforcing member and secondary interior cylindrical connecting member.

The present invention consists of a primary interior cylindrical reinforcing member protruding in a perpendicular direction from non-fronting surface of interior spanning portion of interior metal plate. During installation a circular hole is drilled through wall in the vicinity of deadbolt recess. It is through this hole that primary interior cylindrical reinforcing member is inserted. During installation an aperture in primary interior cylindrical reinforcing member is aligned with deadbolt recess in doorjamb facing. When door is in the closed and locked position the deadbolt passes through this aperture and into primary interior cylindrical reinforcing member. The interior edge of deadbolt lies in direct contact with interior edge of aperture.

The present invention consists of an exterior metal plate composed of an exterior-spanning portion shaped to conform to and overlap width of exterior door molding and an exterior flange portion overlapping exterior wall surface. Thus the exterior spanning portion and the exterior flange portion together form the exterior metal plate. The exterior metal plate simply is retrofitted on top of the exterior door molding and the exterior wall surface. Thus the exterior metal plate is clearly visible on exterior of doorway and provides a visual deterrent to forced entry. The exterior metal plate serves as a backing plate for the interior metal plate. The surface area of exterior metal plate aiding in the dispersion of the force of a powerful blow. Additionally the exterior metal plate provides rigid structural support for primary exterior cylindrical reinforcing member and secondary exterior cylindrical connecting member.

Interior metal plate and exterior metal plate being rigidly attached by means of an interference fit between primary interior cylindrical reinforcing member and primary exterior cylindrical reinforcing member. Additionally interior metal plate and exterior metal plate being rigidly attached by means of an interference fit between secondary interior cylindrical connecting member and secondary exterior cylindrical connecting member.

For installation of the present invention the drilling of only two holes is required. The holes pass through the wall perpendicular to the wall surface. The ends of primary interior cylindrical reinforcing member, secondary interior cylindrical connecting member, primary exterior cylindrical reinforcing member, and secondary exterior cylindrical connecting member are inserted into these holes. The ends of primary interior cylindrical reinforcing member, and secondary interior cylindrical connecting member are inserted from the inside of the residence toward the outside of the residence. The ends of primary exterior cylindrical reinforcing member, and secondary exterior cylindrical connecting member are inserted from the outside of the residence toward the inside of the residence. The ends of the above mentioned members meet within the wall. Specifically contact is made between the ends of primary interior cylindrical reinforcing member and primary exterior cylindrical reinforcing member. Additionally contact is made between the ends of secondary interior cylindrical connecting member and secondary exterior cylindrical connecting member. When contact is made pressure is applied. The pressure serves to force the interference fit between the ends of the above mentioned members.

The aperture can be configured in several ways. In an effort to increase the contact surface area between the deadbolt and aperture interface a protruding lip a set at a right angle to primary interior cylindrical reinforcing member can be utilized. Additionally in an effort to reduce three-dimensional movement of the deadbolt the aperture may open to an inverted box. The deadholt then fits snuggly in the inverted box.

A means of dampening the force of the blow meant to force the door can be provided. One such means of dampening can be provided through a coil spring. Built into the hollow of the primary interior cylindrical reinforcing member is an internal coil spring dampener. The opposing force exerted by the internal coil spring counters the force of a blow.

Reference Numerals in Drawings

Figure 1:
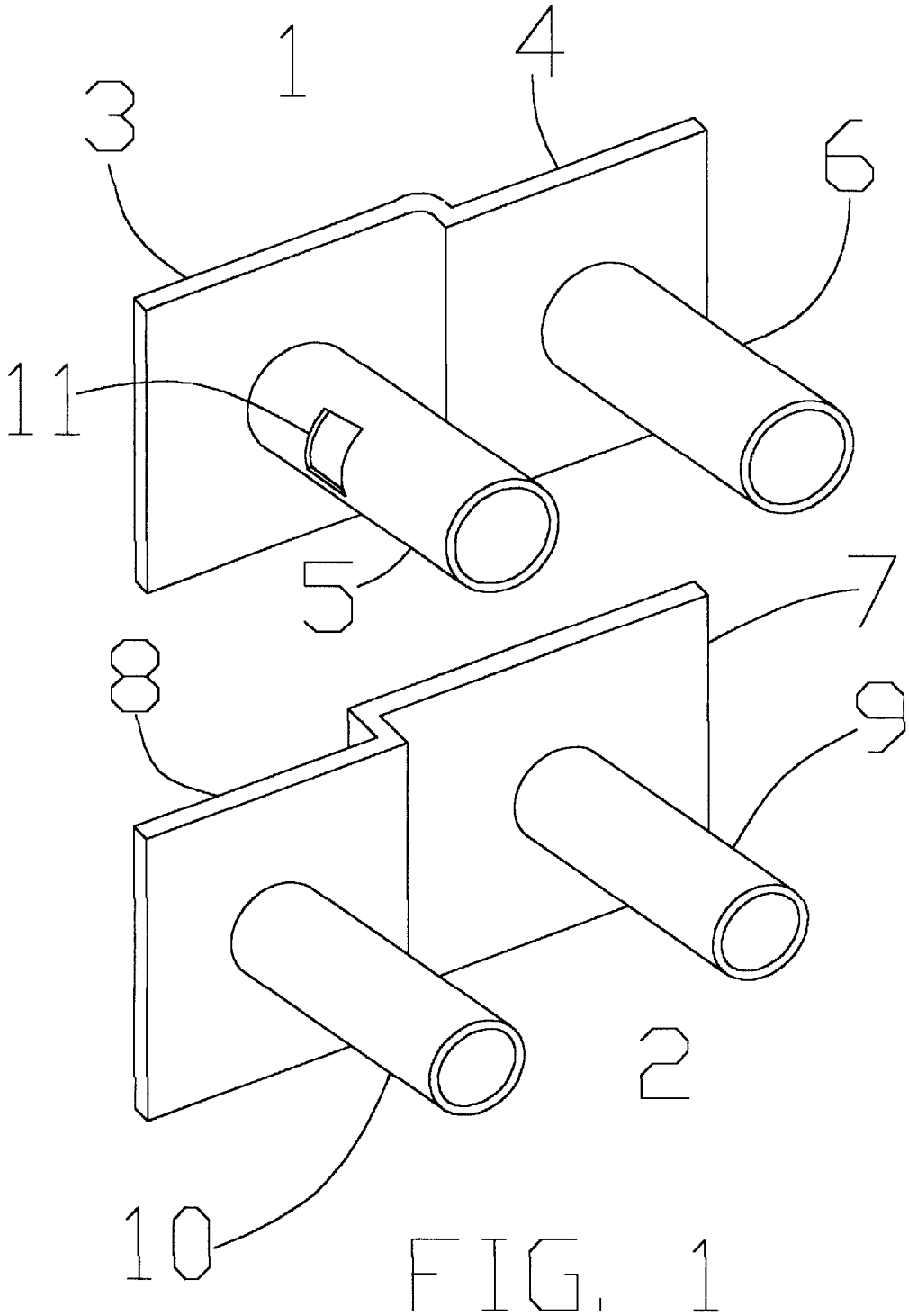
FIG. 1 shows an isometric view of non-fronting surfaces of the present invention.

| | |
|---|---|
| 1. interior metal plate | 2. exterior metal plate |
| 3. interior spanning portion | 4. interior flange portion |
| 5. primary interior cylindrical reinforcing member | 6. secondary interior cylindrical connecting member |
| 7. exterior spanning portion | 8. exterior flange portion |
| 9. primary exterior cylindrical reinforcing member | 10. secondary exterior cylindrical connecting member |
| 11. aperture | 12. deadbolt |
| 13. doorframe studs | 14. interior door molding |

-continued

| Reference Numerals in Drawings | |
|---|---|
| 15. interior wall surface | 16. exterior door molding |
| 17. exterior wall surface | 18. internal coil spring damper |
| 19. interior end | 20. exterior end |
| 21. inverted lip | 22. deadbolt recess |
| 23. inverted box | |

DETAILED DESCRIPTION

Referring now to the drawings and more particularly to FIG. 1 an isometric view of interior metal plate 1 and exterior metal plate 2 is shown. Interior metal plate 1 is composed of an interior spanning portion 3 and an interior flange portion 4. Extending from interior spanning portion 3 is a primary interior cylindrical reinforcing member 5. Positioned on side of primary interior cylindrical reinforcing member 5 is an aperture 11. Extending from interior flange portion 4 is a secondary interior cylindrical connecting member 6. Exterior metal plate 2 is composed of an exterior spanning portion 7 and an exterior flange portion 8. Extending from exterior spanning portion 7 is a primary exterior cylindrical reinforcing member 9. Extending from exterior flange portion 8 is a secondary exterior cylindrical connecting member 10.

Figure 2:
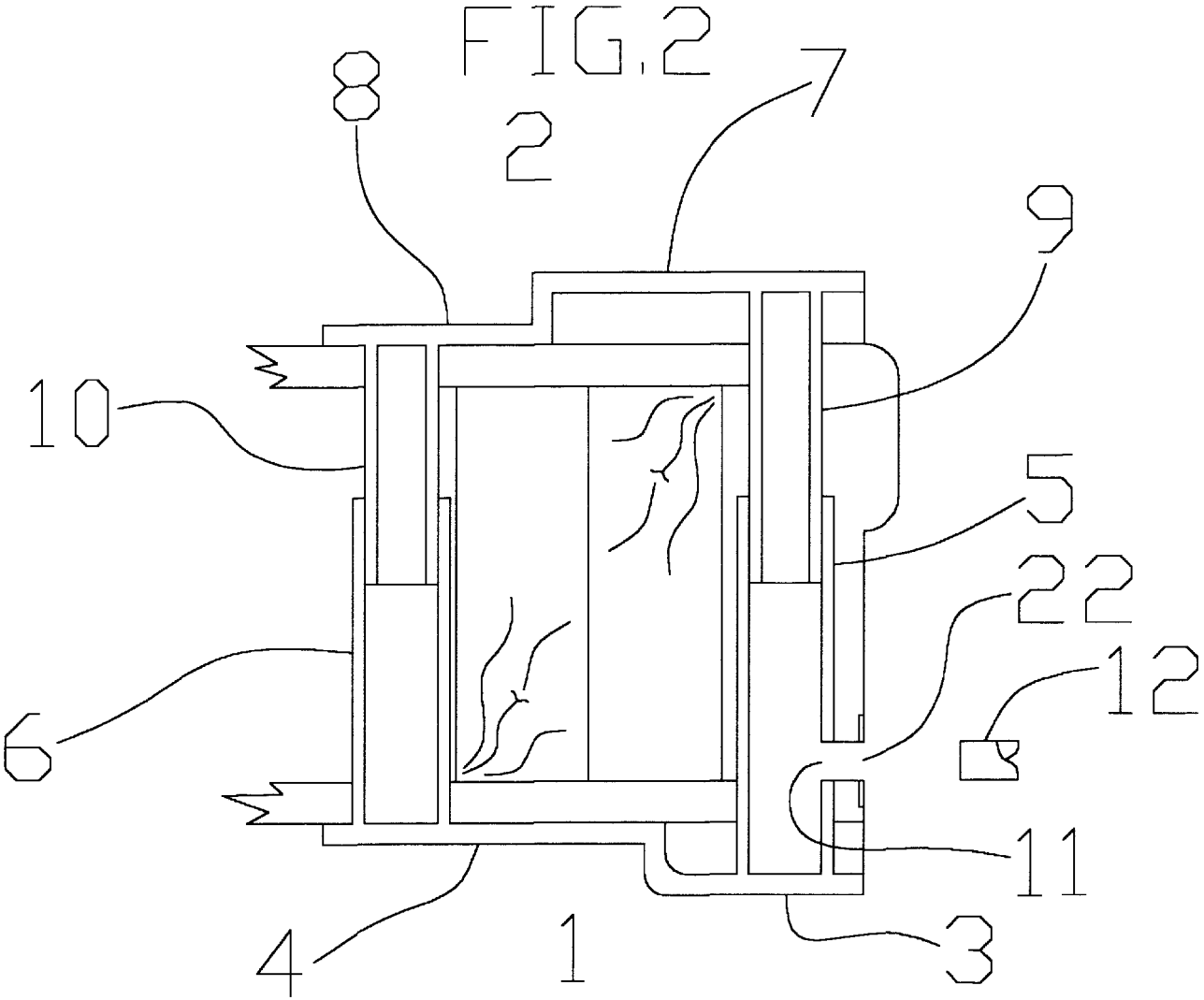
FIG. 2 shows a top cross-sectional view showing the present invention affixed to doorway.

FIG. 2 shows a top cross-sectional view of interior metal plate 1 rigidly attached to exterior metal plate 2. This is accomplished by an interference fit between primary interior cylindrical reinforcing member 5 and primary exterior cylindrical reinforcing member 9. Additionally this is accomplished by interference fit between secondary interior cylindrical connecting member 6 and secondary exterior cylindrical connecting member 10. Further this device utilizes the compressive forces brought about through the interference fit to rigidly hold device in position on unhinged side of doorway in the vicinity of the deadbolt recess 22.

Primary interior cylindrical reinforcing member 5 is integral to interior spanning portion 3. Long axis of primary interior cylindrical reinforcing member 5 projects perpendicularly from non-fronting surface of interior spanning portion 3 toward primary exterior cylindrical reinforcing member 9. Primary interior cylindrical reinforcing member 5 is hollow. Outside diameter of primary interior cylindrical reinforcing member 5 being sufficient to allow for adequate penetration of deadbolt 12. Additionally, inside diameter of primary interior cylindrical reinforcing member 5 being sufficient to allow for an adequate interference fit with primary exterior cylindrical reinforcing member 9. Long axis of primary interior cylindrical reinforcing member 5 being perpendicular to long axis of deadbolt 12. Length of primary interior cylindrical reinforcing member 5 being sufficient to meet primary exterior cylindrical reinforcing member 9 to allow for rigid attachment of two members respectively. Thus primary interior cylindrical reinforcing member 5 serves to rigidly fasten interior metal plate 1 to exterior metal plate 2.

Aperture 11 allows for insertion of deadbolt 12 into primary interior cylindrical reinforcing member 5. Interior edge of deadbolt 12, being the edge closest the interior of residence, lies in direct contact with interior edge of aperture 11 when door is in the closed and locked position. Thus the load path of a powerful blow is transmitted through deadbolt 12 to primary interior cylindrical reinforcing member 5 rather than directly to that portion of wooden doorjamb from interior edge of deadbolt recess 22 to interior of residence. Primary interior cylindrical reinforcing member 5 is made of metal and is stronger than that portion of wooden doorjamb from interior edge of deadbolt recess 22 to interior of residence. Primary interior cylindrical reinforcing member 5 is capable of withstanding the force that drives deadbolt 12 toward interior of residence.

Secondary interior cylindrical connecting member 6 is integral to interior flange portion 4. Long axis of secondary interior cylindrical connecting member 6 projects perpendicularly from non-fronting surface of interior flange portion 4 toward secondary exterior cylindrical connecting member 10. Inside diameter of secondary interior cylindrical connecting member 6 being sufficient to allow for an adequate interference fit with secondary exterior cylindrical connecting member 10. Length of secondary interior cylindrical connecting member 6 being sufficient to meet secondary exterior cylindrical connecting member 10 to allow for rigid attachment of two members respectively. Thus secondary interior cylindrical reinforcing member 6 serves to rigidly fasten interior metal plate 1 to exterior metal plate 2.

Referring further to FIG. 2 it is shown that primary exterior cylindrical reinforcing member 9 is integral to exterior spanning portion 7. Long axis of primary exterior cylindrical reinforcing member 9 projects perpendicularly from non-fronting surface of exterior spanning portion 7 toward primary interior cylindrical reinforcing member 5. Primary exterior cylindrical reinforcing member 9 is hollow. Outside diameter of primary exterior cylindrical reinforcing member 9 being sufficient to allow for an adequate interference fit with primary interior cylindrical reinforcing member 5. Length of primary exterior cylindrical reinforcing member 9 being sufficient to meet primary interior cylindrical reinforcing member 5 to allow for rigid attachment of two members respectively. Thus primary exterior cylindrical reinforcing member 9 serves to rigidly fasten exterior metal plate 2 to interior metal plate 1.

Secondary exterior cylindrical connecting member 10 is integral to exterior flange portion 8. Long axis of secondary exterior cylindrical connecting member 10 projects perpendicularly from non-fronting surface of exterior flange portion 8 toward secondary interior cylindrical connecting member 6. Outside diameter of secondary exterior cylindrical connecting member 10 being sufficient to allow for an adequate interference fit with secondary interior cylindrical connecting member 6. Length of secondary exterior cylindrical connecting member 10 being sufficient to meet secondary interior cylindrical connecting member 6 to allow for rigid attachment of two members respectively. Thus secondary exterior cylindrical reinforcing member 10 serves to rigidly fasten exterior metal plate 2 to interior metal plate 1.

Figure 3:
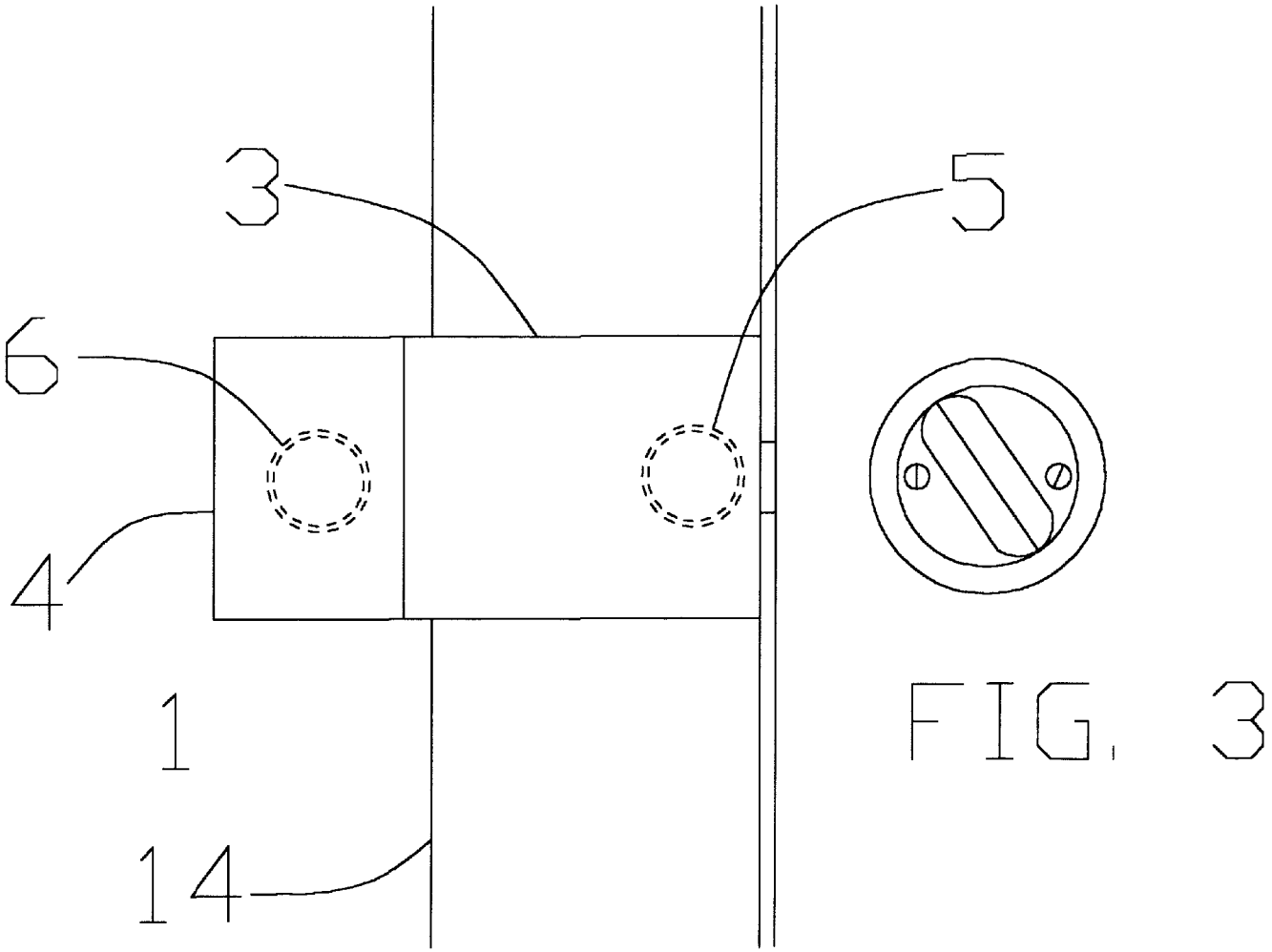
FIG. 3 shows an elevational view of interior metal plate mounted to interior of doorway.

FIG. 3 shows an elevational view of interior metal plate 1. Interior spanning portion 3 has a surface that fronts the interior of a residence and a non-fronting surface that lies in direct contact with interior door molding 14. Interior spanning portion 3 conforms to the general shape of and overlaps the width of interior door molding 14. This eliminates the need to remove interior door molding 14 during installation of doorjamb reinforcing device. Interior flange portion 4 has a surface that fronts the interior of the residence and a non-fronting surface that lies in direct contact with interior wall surface 15. Interior flange portion 4 extends over interior wall surface 15 a distance sufficient to extend past doorframe studs 13. This eliminates the need to drill a hole for insertion of secondary interior cylindrical connecting member 6 through doorframe studs 13 during installation of doorjamb reinforcing device. Interior metal plate 1 serves to provide rigid structural support for primary interior cylindrical reinforcing member 5 represented in this view with hidden lines. Additionally interior metal plate 1 serves to provide rigid structural support for secondary interior cylindrical connecting member 6 represented in this view with hidden lines. Interior metal plate 1 having sufficient bending strength to resist flexure under the load of a powerful blow from outside door. Additionally, interior metal plate 1 having sufficient shearing strength to resist shearing under the load of a powerful blow from outside door.

Figure 4:
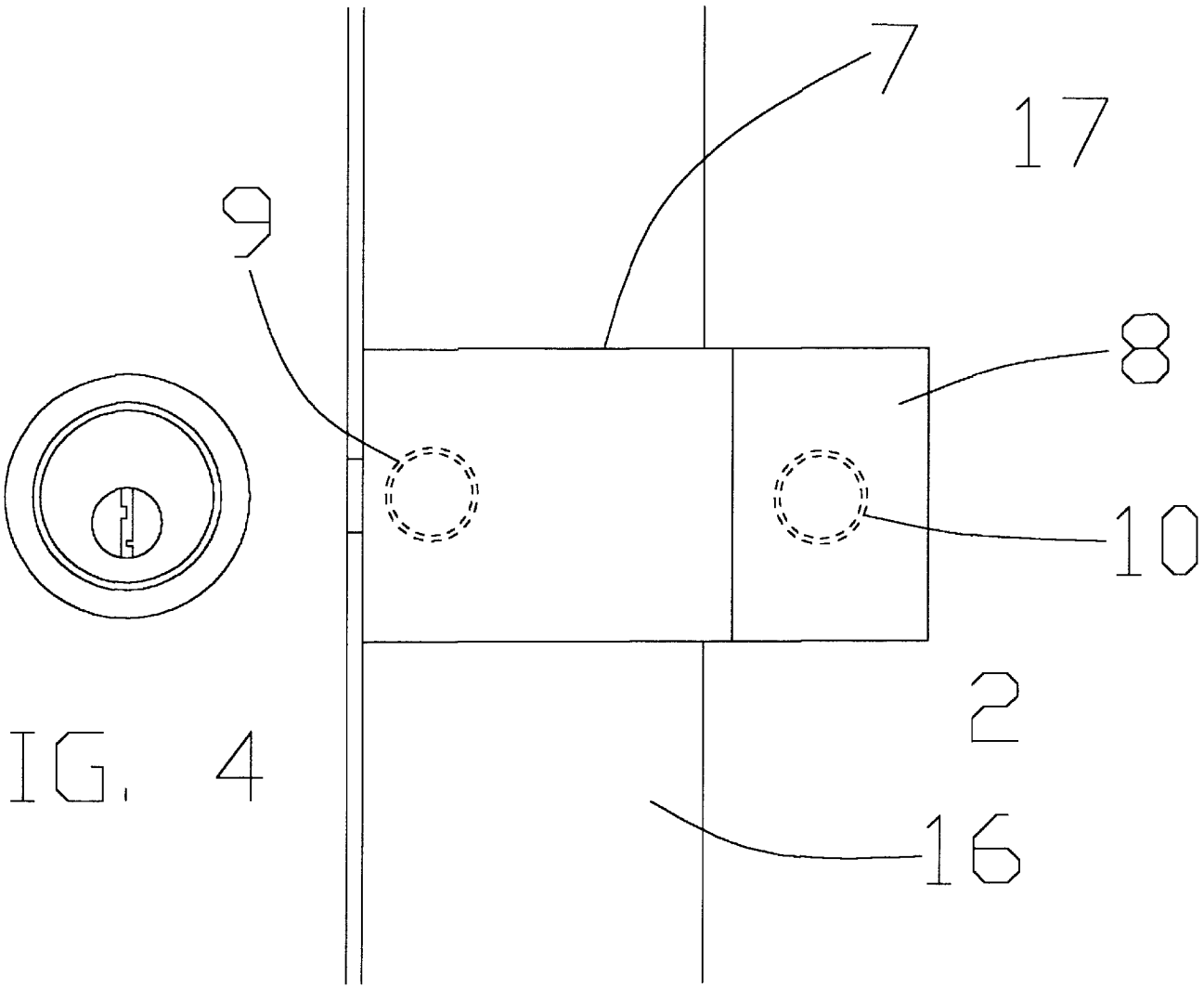
FIG. 4 shows an elevational view of exterior metal plate mounted to exterior of doorway.

FIG. 4 shows an elevational view of exterior metal plate 2. Exterior spanning portion 7 has a surface that fronts the exterior of a residence and a non-fronting surface that lies in direct contact with exterior door molding 16. Exterior spanning portion 7 conforms to the general shape of and overlaps the width of exterior door molding 16. This eliminates the need to remove exterior door molding 16 during installation of doorjamb reinforcing device. Exterior flange portion 8 has a surface that fronts the exterior of the residence and a non-fronting surface that lies in direct contact with exterior wall surface 17. Exterior flange portion 8 extends over exterior wall surface 17 a distance sufficient to extend past doorframe stud 13. This eliminates the need to drill a hole for insertion of secondary exterior cylindrical connecting member 10 through doorframe studs 13 during installation of doorjamb reinforcing device. Exterior metal plate 2 serves to provide a rigid structural support for primary exterior cylindrical reinforcing member 9 represented in this view with hidden lines. Furthermore exterior metal plate 2 serves to provide rigid structural support for secondary exterior cylindrical connecting member 10 represented in this view with hidden lines. Exterior metal plate 2 serves as a backing plate for interior metal plate 1. The surface area of exterior metal plate 2 aids in dispersing the force of a powerful blow from outside door. Exterior metal plate 1 having sufficient bending strength to resist flexure under the load of a powerful blow from outside door. Additionally, interior metal plate 1 having sufficient shearing strength to resist shearing under the load of a powerful blow from outside door.

Figure 5:
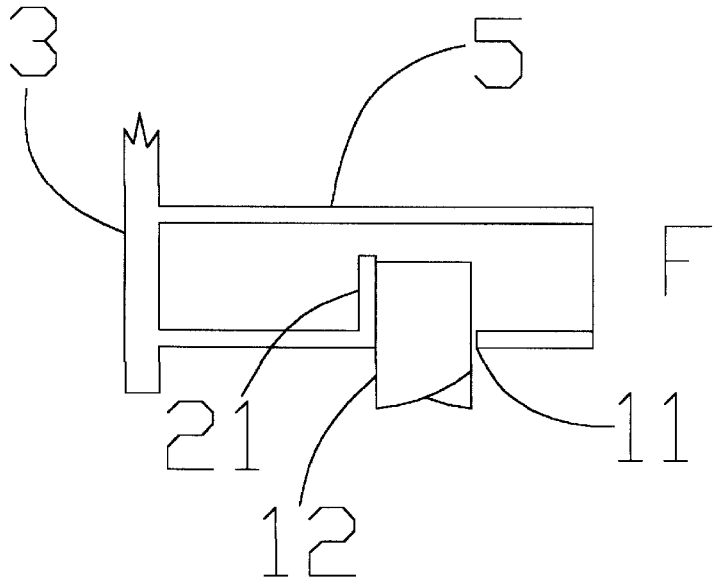
FIG. 5 shows a cross-sectional view of a further embodiment of primary interior cylindrical reinforcing member wherein the aperture contains an inverted lip.

FIG. 5 shows a cross-sectional view of a further embodiment of primary interior cylindrical reinforcing member 5 wherein the aperture 11 contains an inverted lip 21. Inverted lip 21 is perpendicular to long axis of primary interior cylindrical reinforcing member 5. Inverted lip 21 is located on interior edge of aperture 11. Interior edge of deadbolt 12 lies in direct contact with inverted lip 21 when deadbolt 12 is in the closed and locked position. This provides a greater contact area between primary interior cylindrical reinforcing member 5 and deadbolt 12.

Figure 6:
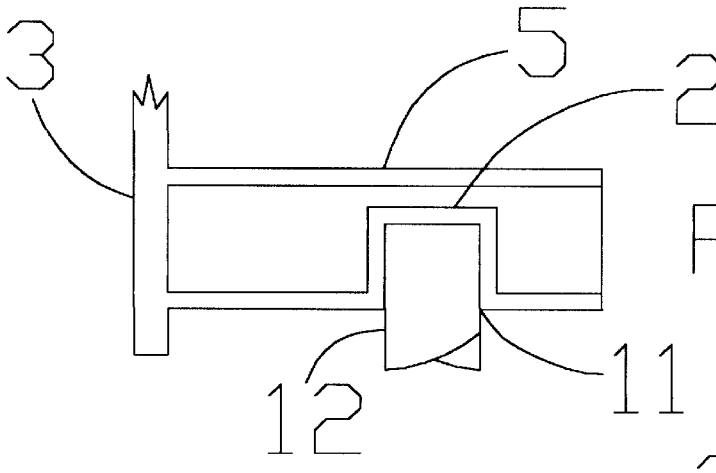
FIG. 6 shows a cross-sectional view of a further embodiment of primary interior cylindrical reinforcing member wherein the aperture opens to an inverted box.

FIG. 6 shows a cross-sectional view of a further embodiment of primary interior cylindrical reinforcing member 5 wherein the aperture 11 opens to an inverted box 23. Deadbolt 12 fits snuggly in inverted box 23 when deadbolt 12 is in the closed and locked position. This provides a greater contact area between primary interior cylindrical reinforcing member 5 and deadbolt 12.

Figure 7:
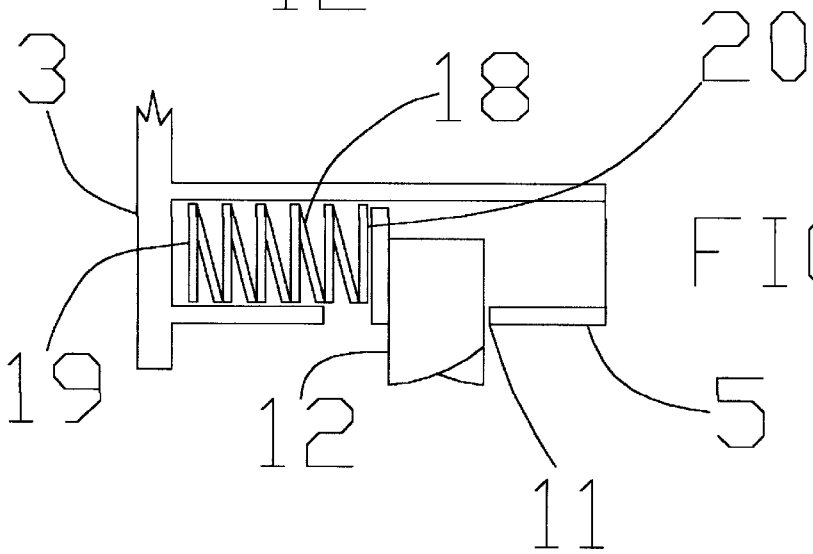
FIG. 7 shows a cross-sectional view of a further embodiment of primary interior cylindrical reinforcing member and internal coil spring damper.

FIG. 7 shows a cross-sectional view of a further embodiment of primary interior cylindrical reinforcing member 5 wherein primary interior cylindrical reinforcing member 5 contains an internal coil spring damper 18. Internal coil spring damper 18 dampens the force that drives deadbolt 12 toward interior of residence. Long axis of internal coil spring damper 18 is coaxial with long axis of primary interior cylindrical reinforcing member 5. Diameter of internal coil spring damper 18 being sufficient to fit snuggly in hollow of primary interior cylindrical reinforcing member 5. Length of internal coil spring damper 18 being sufficient to engage interior edge of deadbolt 12 when internal coil spring damper 18 is in the relaxed state. Internal coil spring damper 18 has an interior end 19 and an exterior end 20. Interior end 19 is the end closest the interior of the residence. Interior end 19 lies in direct contact with non-fronting surface of interior spanning portion 3. Exterior end 20 is the end closed the exterior of the residence. In this embodiment interior edge of aperture 11 does not lie in direct contact with interior edge of deadbolt 12 when deadbolt 12 is in the closed and locked position. Exterior end 20 lies in direct contact with interior edge of deadbolt 12 when deadbolt 12 is in the closed and locked position. The force of a blow from outside the door drives deadbolt 12 toward the interior of residence and against internal coil spring damper 18. As internal coil spring damper 18 contracts under the inwardly directed force driving deadbolt 12 toward the interior of residence internal coil spring damper 18 exerts an outwardly directed force on deadbolt 12. This has the effect of opposing and dampening the inwardly directed force driving deadbolt 12 toward interior of the residence.

What is claimed is:

1. A doorjamb strengthening device for use with a door frame, said door frame including an interior door molding, and an exterior door molding, and a fronting surface, said doorjamb strengthening device comprising:

an interior metal plate composed of an interior spanning portion shaped to conform to and overlap the width of the interior door molding that is integrally attached to an interior flange portion that overlaps the interior wall surface;

a primary interior cylindrical reinforcing member and a secondary interior cylindrical connecting member, each protruding in a perpendicular direction from the non-fronting surface of the interior metal plate and an aperture through a side wall of the primary interior cylindrical reinforcing member adapted to receive a deadbolt;

an exterior metal plate composed of an exterior spanning portion shaped to conform to and overlap the width of the exterior door molding that is integrally attached to an exterior flange portion that overlaps the exterior wall surface;

a primary exterior cylindrical reinforcing member and a secondary exterior cylindrical connecting member, each protruding in a perpendicular direction from the non-fronting surface of the exterior metal plate;

whereby said interior metal plate is fastened to said exterior metal plate by an interference fit between said primary interior cylindrical reinforcing member and said primary exterior cylindrical reinforcing member and said secondary interior cylindrical connecting member and said secondary exterior cylindrical connecting member.

2. The doorjamb strengthening device of claim 1, wherein the aperture has a protruding lip set at a right angle to the longitudinal axis of the primary interior cylindrical reinforcing member.

3. The doorjamb strengthening device of claim 2 wherein the aperture opens to an inverted box.

4. The doorjamb strengthening device of claim 1 wherein said primary interior cylindrical reinforcing member is hollow, and contains a means for dampening a force driving said deadbolt toward said interior metal plate.

5. The doorjamb strengthening device of claim 4 wherein the dampening means is an internal coil spring dampener.

* * * * *